US009796196B2

(12) United States Patent
Hamano

(10) Patent No.: US 9,796,196 B2
(45) Date of Patent: Oct. 24, 2017

(54) CARRIAGE AND LIQUID JET RECORDING APPARATUS

(71) Applicant: SII Printek Inc., Chiba-shi, Chiba (JP)

(72) Inventor: Yuichiro Hamano, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 15/353,193

(22) Filed: Nov. 16, 2016

(65) Prior Publication Data

US 2017/0165987 A1 Jun. 15, 2017

(30) Foreign Application Priority Data

Dec. 11, 2015 (JP) ..... 2015-242545

(51) Int. Cl.

| | |
|---|---|
| ***B41J 2/175*** | (2006.01) |
| ***B41J 2/14*** | (2006.01) |
| ***B41J 25/00*** | (2006.01) |
| ***B41J 2/01*** | (2006.01) |
| ***B41J 29/04*** | (2006.01) |
| ***B41J 2/145*** | (2006.01) |
| ***B41J 29/06*** | (2006.01) |

(52) U.S. Cl.

CPC ..... *B41J 25/006* (2013.01); *B41J 2/01* (2013.01); *B41J 2/145* (2013.01); *B41J 2/14024* (2013.01); *B41J 2/1752* (2013.01); *B41J 29/04* (2013.01); *B41J 29/06* (2013.01); *B41J 2202/20* (2013.01)

(58) Field of Classification Search

CPC . B41J 2/01; B41J 2/14024; B41J 2/145; B41J 2/1752; B41J 25/006; B41J 29/04; B41J 29/06; B41J 29/02; B41J 2202/20

See application file for complete search history.

(56) References Cited

U.S. PATENT DOCUMENTS

| | | | | |
|---|---|---|---|---|
| 7,063,468 | B2 * | 6/2006 | Youn | B41J 25/308 347/14 |
| 7,530,681 | B2 * | 5/2009 | Tajima | B41J 2/14024 347/66 |
| 9,150,021 | B2 * | 10/2015 | Ishii | B41J 2/145 |
| 9,216,584 | B2 * | 12/2015 | Moriguchi | B41J 2/1752 |
| 2010/0134558 | A1 | 6/2010 | Shiota | 347/37 |

FOREIGN PATENT DOCUMENTS

| | | |
|---|---|---|
| JP | 2010125832 | 6/2010 |
| JP | 2010201828 | 9/2010 |

* cited by examiner

*Primary Examiner* — Anh T. N. Vo
(74) *Attorney, Agent, or Firm* — Adams & Wilks

(57) ABSTRACT

A carriage includes a base plate, a liquid jet head which includes a support plate attached to the base plate, a first engagement portion which is formed on one end in a Y direction of the support plate, and a fixing tool for positioning the support plate with respect to the base plate, the fixing tool being slidable in an X direction with respect to the base plate and engaged with the first engagement portion. The fixing tool allows movement in the Y direction of the first engagement portion with respect to the fixing tool, and restricts movement in the X direction of the first engagement portion and movement in the thickness direction of the base plate of the first engagement portion with respect to the fixing tool.

13 Claims, 16 Drawing Sheets

CARRIAGE AND LIQUID JET RECORDING APPARATUS

BACKGROUND

Technical Field

The present invention relates to a carriage and a liquid jet recording apparatus equipped with the carriage.

Related Art

Conventionally, there has been known a liquid jet recording apparatus which records characters or images on a recording medium using a liquid jet head (ink jet head) including a plurality of nozzle holes which eject ink. The liquid jet recording apparatus is provided with a carriage whose scanning direction is one direction and a liquid jet head which is attached the carriage. The liquid jet head is provided with a nozzle plate which faces a recording medium.. The nozzle plate includes a plurality of nozzle holes which are arranged in another direction perpendicular to the one direction.

The attachment position accuracy of the liquid jet head (nozzle holes) with respect to the carriage directly affects the quality of images or characters recorded on a recording medium. Thus, there is disclosed a technique in which a liquid jet head is attached through a sliding-contact member which is turnably disposed on a carriage (refer to JP 2010-125832A, for example).

In JP 2010-125832 A, a part of the liquid jet head is brought into abutment against the sliding-contact member to determine the relative position between the sliding-contact member and the liquid jet head. Further, the angle of the sliding-contact member with respect to the carriage is adjusted using, for example, an adjusting bolt to accurately attach the liquid jet head to the carriage.

There is also disclosed a technique in which a carriage is provided with a head support member which includes a guide groove, a slide member which includes a pin movable along the guide groove, and a biasing member (refer to JP 2010-201828 A, for example).

In JP 2010-201828 A, the slide member is moved along the longitudinal direction to perform positioning of the liquid jet head with respect to the longitudinal direction in the carriage. Further, the pin is moved along the guide groove and the biasing member is used to perform positioning of the liquid jet head with respect to the short side direction and the height direction (the thickness direction of the carriage).

SUMMARY

However, in JP 2010-125832 A, the attachment position accuracy of the liquid jet head with respect to the carriage is reduced when the relative position between the sliding-contact member and the liquid jet head is not determined with high accuracy. Thus, it is necessary to process the sliding-contact member with high accuracy, which disadvantageously increases the processing cost. Further, although angle adjustment in the plane direction (hereinbelow, referred to as θ adjustment) of the liquid jet head with respect to the carriage can be performed, it is disadvantageously difficult to perform adjustment in the longitudinal direction and the short side direction of the liquid jet head with respect to the carriage.

On the other hand, in JP 2010-201828 A, the positioning structure of the liquid jet head with respect to the carriage is complicated, which increases the manufacturing cost. Further, although position adjustment of the liquid jet head in the longitudinal direction and the short side direction with respect to the carriage can be performed, it is disadvantageously difficult to perform θ adjustment of the liquid jet head with respect to the carriage.

The present invention has been made in view of the above circumstances and provides a carriage and a liquid jet recording apparatus capable of performing not only θ adjustment of a liquid jet head, but also adjustment in the longitudinal direction of the liquid jet head with a simple structure.

To solve the problems, a carriage according to the present invention includes: a base movable in a first direction; a liquid jet head including a support plate attached to the base, the support plate being elongated in a second direction that intersects the first direction and extends along a plane direction of the base; a first engagement portion formed on one end in the second direction of the support plate; and a fixing tool for positioning the support plate with respect to the base, the fixing tool being slidable in the first direction with respect to the base and engaged with the first engagement portion, wherein the support plate is supported on one face of the base turnably along the one face, and the fixing tool is configured to allow movement in the second direction of the first engagement portion with respect to the fixing tool, and restrict movement in the first direction of the first engagement portion and movement in a thickness direction of the base of the first engagement portion with respect to the fixing tool.

Such a configuration makes it possible to perform adjustment of the liquid jet head (the support plate) and also perform adjustment in the second direction (longitudinal direction) of the liquid jet head with respect to the carriage with a simple structure.

In the carriage according to the present invention, the first engagement portion includes a circular portion formed in a circular shape centered on a straight line extending along the thickness direction.

Such a configuration makes it possible, when the fixing tool is slid, to smoothly turn the one end in the second direction (the first engagement portion) of the support plate with respect to the fixing tool following the fixing tool.

In the carriage according to the present invention, the other end in the second direction of the support plate is turnably supported on the base.

When the other end in the second direction of the support plate is used as the turning center, and the adjustment in the turning direction of the support plate is performed at the one end in the second direction which is opposite to the turning center in this manner, it is possible to easily perform fine adjustment in the turning direction of the support plate. Further, a sufficient distance can be ensured between the turning center and the point of action (the first engagement portion). Thus, it is possible to turn the support plate with a slight force and easily perform the adjustment operation.

The carriage according to the present invention further includes: a second engagement portion formed on the other end in the second direction of the support plate; and a jig for positioning the support plate with respect to the base, the jig being detachably attached to the base, slidable in the second direction with respect to the base, and engaged with the second engagement portion.

Such a configuration makes it possible to more easily perform the adjustment in the second direction (longitudinal direction) of the liquid jet head with respect to the carriage.

In the carriage according to the present invention, the first engagement portion, the fixing tool, and the second engagement portion each include reference attachment holes, each of the reference attachment holes being configured to allow a pin detachably attached, in a standing manner, to the base to be inserted therein.

Such a configuration makes it possible to easily perform rough positioning of the liquid jet head with respect to the base using the pin. The position adjustment operation can be more easily performed by performing position adjustment of the roughly-positioned liquid jet head with respect to the base.

In the carriage according to the present invention, either one of the jig and a part of the base where the jig is disposed includes a slide groove extending along the second direction, and the other one includes a slide projection slidably fitted inside the slide groove, the jig includes a recess configured to receive the second engagement portion and an insertion hole configured to allow a pin detachably attached, in a standing manner, to the base to be inserted therein, and the insertion hole is formed in an elliptical shape so as to allow slide movement in the second direction of the jig.

Such a configuration makes it possible to restrict the movement in the first direction of the second engagement portion with respect to the jig while allowing the movement in the second direction of the second engagement portion with respect to the jig and the turn of the support plate with respect to the carriage with a simple structure.

In the carriage according to the present invention, the fixing tool includes a first groove configured to allow a screw screwed into the base to be inserted therein and a second groove configured to receive the first engagement portion, the first groove is elongated in the first direction so that the fixing tool is slidable in the first direction and unslidable in the second direction with respect to the screw, and the second groove is elongated in the second direction so that the first engagement portion is slidable in the second direction and unslidable in the first direction with respect to the fixing tool.

Such a configuration makes it possible to restrict the movement in the first direction of the first engagement portion with respect to the fixing tool while allowing the movement in the second direction of the first engagement portion with respect to the fixing tool and the turn of the first engagement portion with respect to the fixing tool with a simple structure .

A liquid jet recording apparatus according to the present invention includes: the above-described carriage; a liquid jet head mounted on the carriage; a scanning unit configured to move the carriage and the liquid jet head; a liquid storage body configured to store liquid; and a liquid supply tube configured to circulate the liquid, the liquid supply tube being provided between the liquid jet head and the liquid storage body.

Such a configuration makes it possible to provide the liquid jet recording apparatus capable of performing the θ adjustment of the liquid jet head (the support plate) and also performing the adjustment in the second direction (longitudinal direction) of the liquid jet head with respect to the carriage with a simple structure.

The present invention makes it possible to perform the θ adjustment of the liquid jet head (the support plate) and also perform the adjustment in the second direction (longitudinal direction) of the liquid jet head with respect to the carriage with a simple structure.

DETAILED DESCRIPTION

Hereinbelow, an embodiment according to the present invention will be described with reference to the drawings. In the following embodiment, a liquid jet recording apparatus which jets ink as liquid to perform recording on a recording medium will be described as an example.

(Liquid Jet Recording Apparatus)

Figure 1:
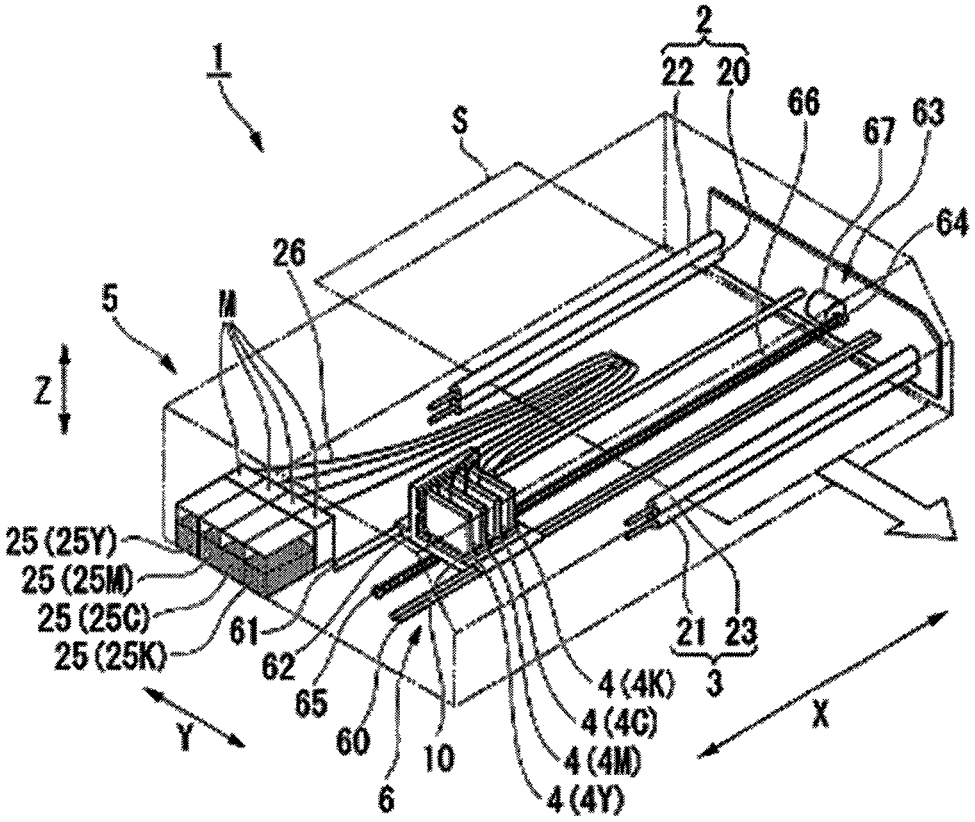
FIG. 1 is a perspective view of a liquid jet recording apparatus in an embodiment of the present invention.

FIG. 1 is a perspective view of a liquid jet recording apparatus 1.

The liquid jet recording apparatus 1 is a so-called ink jet printer and provided with a pair of conveyance mechanisms 2, 3 which conveys a recording medium S such as paper, a liquid jet head 4 which jets ink droplets onto the recording medium S, a liquid supply unit 5 which supplies ink to the liquid jet head 4, and a scanning unit 6 which moves the liquid jet head 4 in a direction (sub-scanning direction) that is substantially perpendicular to a conveyance direction (main-scanning direction) of the recording medium S.

In the following description, the sub-scanning direction is referred to as an X direction, the main-scanning direction is referred to as a Y direction, and a direction perpendicular to both the X direction and the Y direction is referred to as a Z direction. The liquid jet recording apparatus 1 is placed with the X and Y directions aligned with the horizontal direction and the Z direction aligned with the gravity direction (up-down direction) to be used.

That is, the liquid jet head 4 moves on the recording medium S along the horizontal direction (X and Y directions) when the liquid jet recording apparatus 1 is placed. The liquid jet head 4 jets ink droplets downward in the gravity direction (downward in the Z direction) so that the ink droplets land on the recording medium S.

The conveyance mechanism 2 is provided with a grid roller 20 which extends in the X direction, a pinch roller 22 which extends parallel to the grid roller 20, and a drive mechanism (not specifically illustrated) such as a motor which rotates the grid roller 20 around a shaft thereof. Similarly, the conveyance mechanism 3 is provided with a grid roller 21 which extends in the X direction, a pinch roller 23 which extends parallel to the grid roller 21, and a drive mechanism (not specifically illustrated) which rotates the grid roller 21 around a shaft thereof.

The liquid supply unit 5 is provided with a liquid storage body 25 which stores ink therein and a liquid supply tube 26 which connects the liquid storage body 25 to the liquid jet head 4. The liquid storage body 25 includes a plurality of ink tanks, for example, ink tanks 25Y, 25M, 25C, 25K which respectively store therein four kinds of ink, specifically, yellow ink, magenta ink, cyan ink and black ink and are arranged side by side. Each of the ink tanks 25Y, 25M, 25C, 25K is provided with a pump motor M so that ink can be pressed and moved to the liquid jet head 4 through the liquid supply tube 26. The liquid supply tube 26 includes a flexible hose which has flexibility and is capable of following the action of a carriage 62 which supports the liquid jet head 4.

The liquid storage body 25 is not limited to the ink tanks 25Y, 25M, 25C, 25K which respectively store therein four kinds of ink, specifically, yellow ink, magenta ink, cyan ink and black ink. The liquid storage body 25 may include ink tanks which store more colors of ink.

The scanning unit 6 is provided with a pair of guide rails 60, 61 which extend in the X direction, the carriage 62 which is slidable along the pair of guide rails 60, 61, and a drive mechanism 63 which moves the carriage 62 in the X direction. The drive mechanism 63 is provided with a pair of pulleys 64, 65 which is disposed between the guide rails 60, 61, an endless belt 66 which is wound around the pair of pulleys 64, 65, and a drive motor 67 which drives the pulley 64 to rotate.

The pulley 64 is disposed between one end of the guide rail 60 and one end of the guide rail 61 and arranged at intervals in the X direction, and the pulley 65 is disposed between the other end of the guide rail 60 and the other end of the guide rail 61 and arranged at intervals in the X direction. The endless belt 66 is disposed between the guide rails 60, 61. The carriage 62 is coupled to the endless belt 66.

A plurality of liquid jet heads 4 are attached to the carriage 62. In the present embodiment, four liquid jet heads 4, specifically, liquid jet heads 4Y, 4M, 4C, 4K which respectively jet yellow (Y) ink, magenta (M) ink, cyan (C) ink, and black (K) ink are attached to the carriage 62. All the liquid jet heads 4Y, 4M, 4C, 4K have the same configuration except the color of ink supplied thereto. Thus, in the following description, the liquid jet heads 4Y, 4M, 4C, 4K will be collectively described as the liquid jet heads 4.

(Liquid Jet Head)

Figure 2:
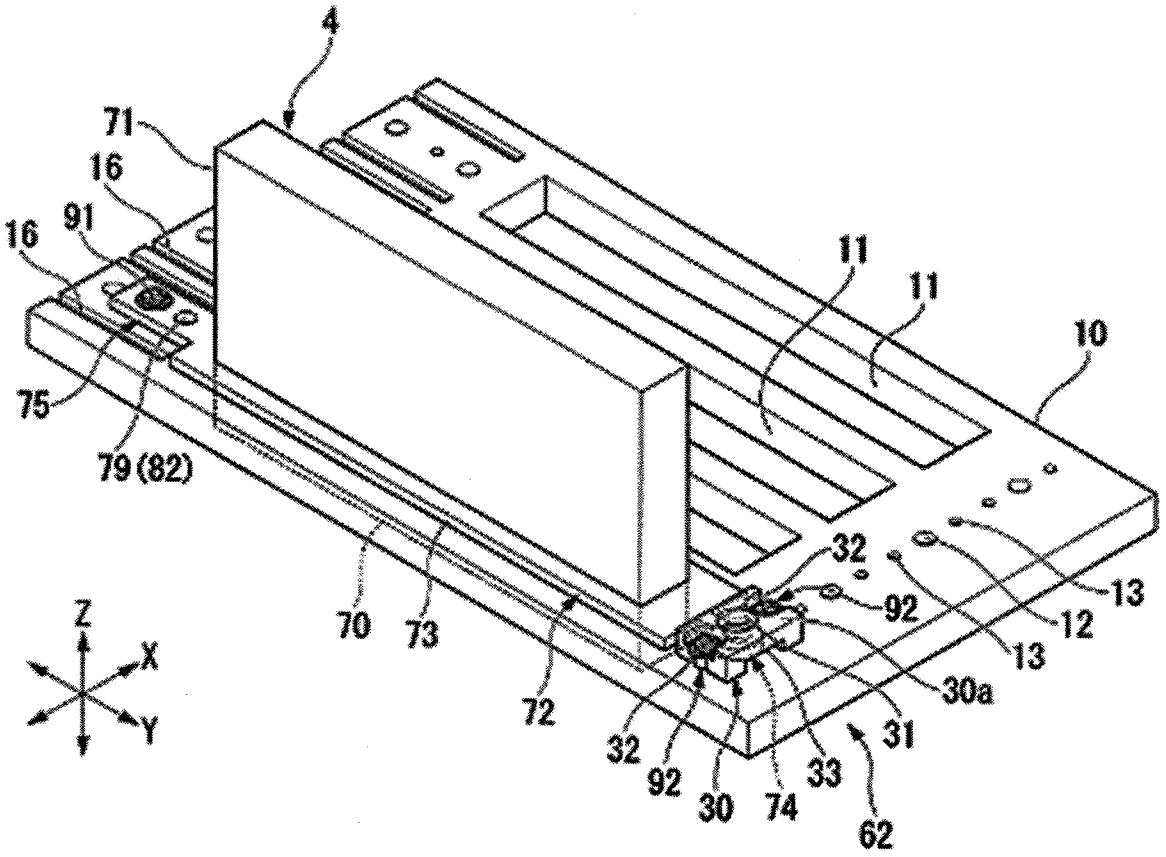
FIG. 2 is a perspective view illustrating a carriage with one liquid jet head attached in the embodiment of the present invention.
Figure 3:
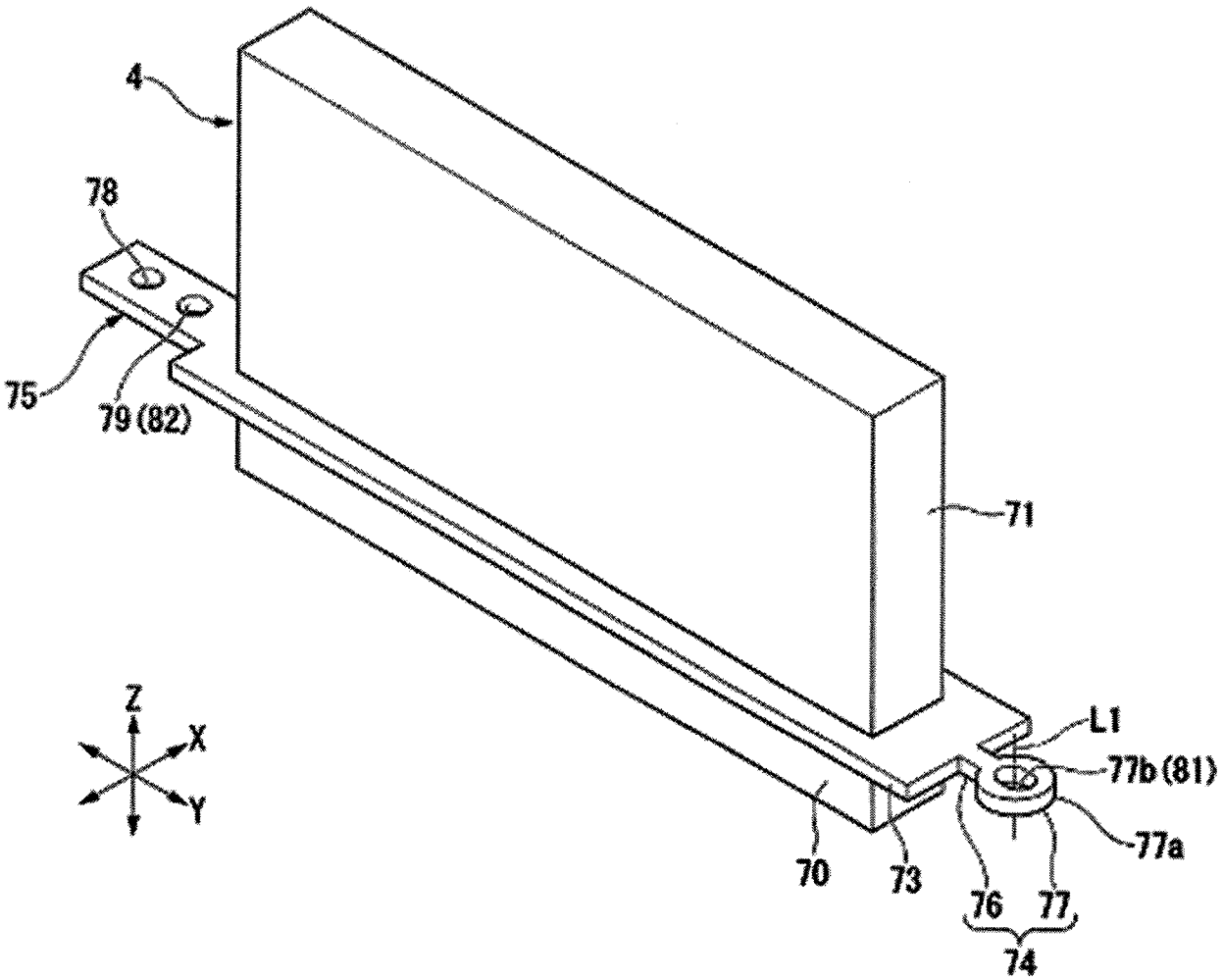
FIG. 3 is a perspective view of the liquid jet head in the embodiment of the present invention.

FIG. 2 is a perspective view illustrating the carriage 62 with one liquid jet head 4 attached. FIG. 3 is a perspective view of the liquid jet head 4. The four liquid jet heads 4 are actually attached to the carriage 62. However, for easy understanding of the description, a state in which only one liquid jet head 4 is attached to the carriage 62 is illustrated (the same applies to the drawings used in the following description).

As illustrated in FIGS. 2 and 3, the liquid jet head 4 is provided with a head chip 70 which ejects ink droplets and is located in a lower part in the Z direction and a head body 71 which is located on the upper part in the Z direction of the head chip 70. The entire liquid jet head 4 has a substantially rectangular parallelepiped shape elongated in the Y direction.

The head chip 70 includes an actuator plate (not illustrated) which has a substantially rectangular parallelepiped shape elongated in the Y direction and a nozzle plate (not illustrated) which is disposed on the Z-direction lower end face of the actuator plate. The actuator plate is formed of a piezoelectric material such as lead zirconate titanate (PZT) and includes a plurality of channels which can be filled with ink. The channels are formed at predetermined intervals in the Y direction.

The nozzle plate is made of a film material such as polyimide or metal and has a sheet-like shape. The nozzle plate includes a plurality of nozzle holes which communicate with the respective channels. That is, the nozzle holes are arranged at predetermined intervals in the Y direction.

The capacity of each of the channels changes by the application of desired drive voltage to the actuator plate. Accordingly, ink is ejected from the each of the nozzle holes.

The head body 71 includes a liquid circulation unit (not illustrated) to which the liquid supply tube 26 (refer to FIG. 1) is connected and a control unit (not illustrated) for applying desired drive voltage to the head chip 70. Ink flowing from the liquid supply tube 26 is supplied to the head chip 70 through the liquid circulation unit. The liquid circulation unit functions as a pressure buffer. When ink is supplied to the liquid circulation unit through the liquid supply tube 26, the liquid circulation unit temporarily stores the ink in a storage chamber inside thereof and then supplies a predetermined amount of ink to the head chip 70.

Under such a configuration, as illustrated in FIGS. 1 and 2, for example, the recording medium S is conveyed in the conveyance direction Y by the pair of conveyance mechanisms 2, 3 and, at the same time, each of the liquid jet heads 4 is reciprocated in the scanning direction X through the carriage 62 by the scanning unit 6. During this operation, ink is ejected from each of the nozzle holes of each of the liquid jet heads 4. As a result, various kinds of information such as characters or images are recorded on the recording medium S using the four colors of ink.

(Support Plate)

The head chip 70 of the liquid jet head 4 is provided with a support plate 72. The liquid jet head 4 is fixed to the carriage 62 through the support plate 72.

The support plate 72 includes a plate body 73 which projects from the periphery of the head chip 70 along the X-Y plane and has a rectangular shape elongated in the Y direction. A first engagement portion 74 extends from one end in the Y direction of the plate body 73. A second engagement portion 75 extends from the other end in the Y direction of the plate body 73.

The first engagement portion 74 and the second engagement portion 75 are used for performing positioning between the carriage 62 and the support plate 72 (the liquid jet head 4) and fixing the support plate 72 to the carriage 62.

The first engagement portion 74 includes a leg 76 which extends toward one side in the Y direction from substantially the X-direction center at the one end in the Y direction of the plate body 73 and a head 77 which is integrally molded with the tip of the leg 76 and has a substantially annular shape. The head 77 includes an outer peripheral face 77*a* which is formed in a circular shape centered on a straight line L1 extending along the thickness direction of the plate body 73. The head 77 includes an inner peripheral face 77*b* which is formed in an elliptical shape slightly elongated along the Y direction.

The inner peripheral face 77*b* functions as an engagement portion side first reference hole 81 for determining the relative position between the carriage 62 and the support plate 72. The inner peripheral face 77*b* is located at substantially the same position as a base side first reference hole 12 of a base plate (base) 10 (described below) when viewed from the Z direction with the liquid jet head 4 attached to the carriage 62. The width of the inner peripheral face 77*b* is set to be substantially equal to the hole diameter of the base side first reference hole 12. The length of the inner peripheral face 77*b* is set to be slightly larger than the hole diameter of the base side first reference hole 12. In the following description, the inner peripheral face 77*b* is referred to as the engagement portion side first reference hole 81.

On the other hand, the second engagement portion 75 extends toward the other side in the Y direction from substantially the X-direction center at the other end in the Y direction of the plate body 73. The second engagement portion 75 is formed in a substantially rectangular shape elongated in the Y direction. The second engagement portion 75 includes two through holes 78, 79 which are arranged side by side in the Y direction. The through hole 78 which is located at the other side in the Y direction of the second engagement portion 75 functions as a screw hole into which a screw 91 (described below) is inserted.

In the two through holes 78, 79, the other through hole 79 functions as an engagement portion side second reference hole 82 for determining the relative position between the carriage 62 and the support plate 72. The through hole 79 is located at substantially the same position as a base side second reference hole 14 of the base plate 10 when viewed from the Z direction with the liquid jet head 4 attached to the carriage 62. The hole diameter of the through hole 79 is set to be substantially equal to the hole diameter of the base side second reference hole 14. In the following description, the through hole 79 is referred to as the engagement portion side second reference hole 82.

(Carriage)

Figure 4:
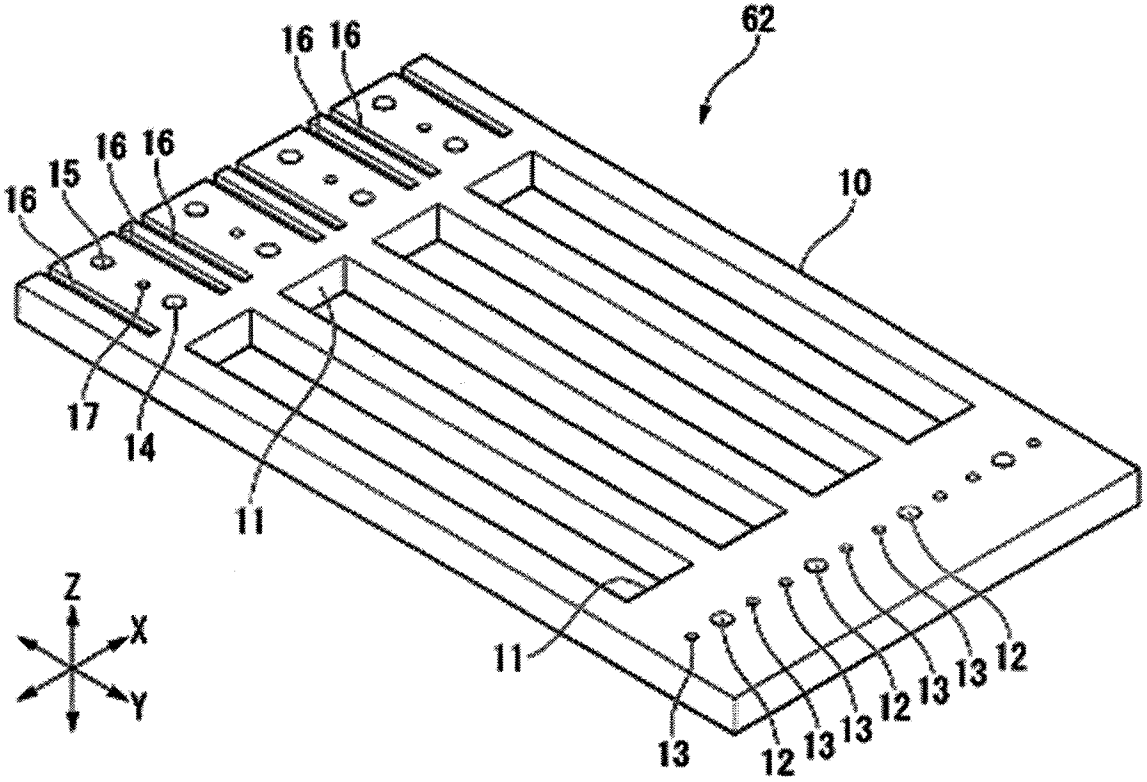
FIG. 4 is a perspective view of a base plate in the embodiment of the present invention.

FIG. 4 is a perspective view of the base plate 10 of the carriage 62.

As illustrated in FIGS. 2 and 4, the carriage 62 includes the base plate 10. The base plate 10 is slidably coupled to the pair of guide rails 60, 61 (refer to FIG. 1) and coupled to the endless belt 66 (refer to FIG. 1).

The base plate 10 includes a plurality of attachment openings 11 (for example, four attachment openings 11 in the present embodiment) which are arranged side by side in the X direction. Each of the attachment openings 11 has a substantially rectangular shape elongated in the Y direction. Each of the attachment openings 11 is slightly larger than the shape of the outer peripheral face of the head chip 70.

The head chip 70 of each of the liquid jet heads 4 is inserted into the corresponding attachment opening 11 from the upper side in the Z direction. That is, the liquid jet heads 4 are arranged side by side in the X direction with the longitudinal direction aligned with the Y direction so as to correspond to the respective attachment, openings 11.

The base plate 10 includes base side first reference holes 12 each of which is formed at a position corresponding to the first engagement portion 74 (refer to FIG. 3) of the support plate 72 at the one side in the Y direction of the corresponding attachment opening 11. Each of the base side first reference holes 12 overlaps the first reference hole 81 of the first engagement portion 74 in the Z direction (the thickness direction of the base plate 10). Further, female thread portions 13 are formed in an engraved form on both sides in the X direction across each of the base side first reference holes 12.

The base plate 10 includes female thread portions 17 in an engraved form and base side second reference holes 14. Each of the female thread portions 17 and each of the base side second reference holes 14 are formed at a position corresponding to the second engagement portion 75 (refer to FIG. 3) of the support plate 72 at the other side in the Y direction. The female thread portion 17 is formed at the same position as the through hole 78 of the second engagement portion 75 when viewed from the Z direction. The base side second reference hole 14 is formed at the same position as the engagement portion side second reference hole 82 of the second engagement portion 75 when viewed from the Z direction.

The base plate 10 further includes base side third reference holes 15. Each of the base side third reference holes 15 is formed at the opposite side (the other side) of the base side second reference hole 14 across the female thread portion 17. The hole diameter of the base side second reference hole 14, the hole diameter of the base side third reference hole 15, and the hole diameter of the base side first reference hole 12 are all set to be equal to each other.

The female thread portion 17, the base side second reference hole 14, and the base side third reference hole 15 are arranged side by side in the Y direction. Slide grooves 16 are formed on both sides in the X direction across the female thread portion 17, the base side second reference hole 14, and the base side third reference hole 15. Each of the slide grooves 16 is used for restricting a movement direction of a jig 40 (described below) and elongated in the Y direction.

Figure 7:
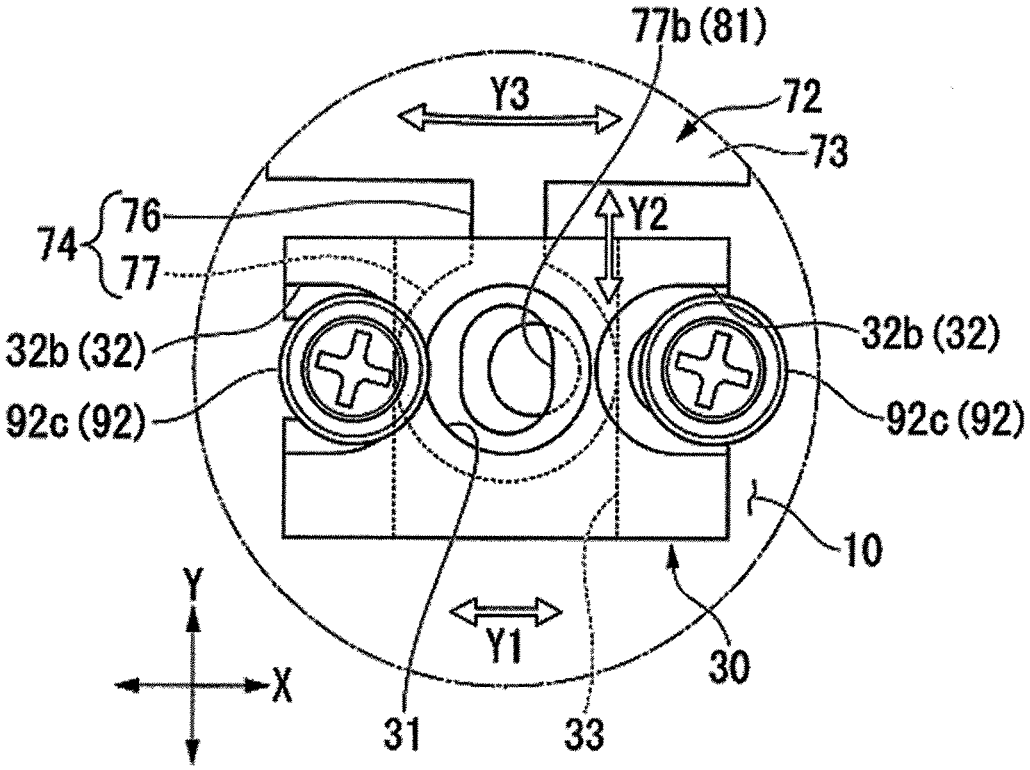
FIG. 7 is a perspective view of the fixing tool viewed from the upper side in a Z direction in the embodiment of the present invention.
Figure 8:
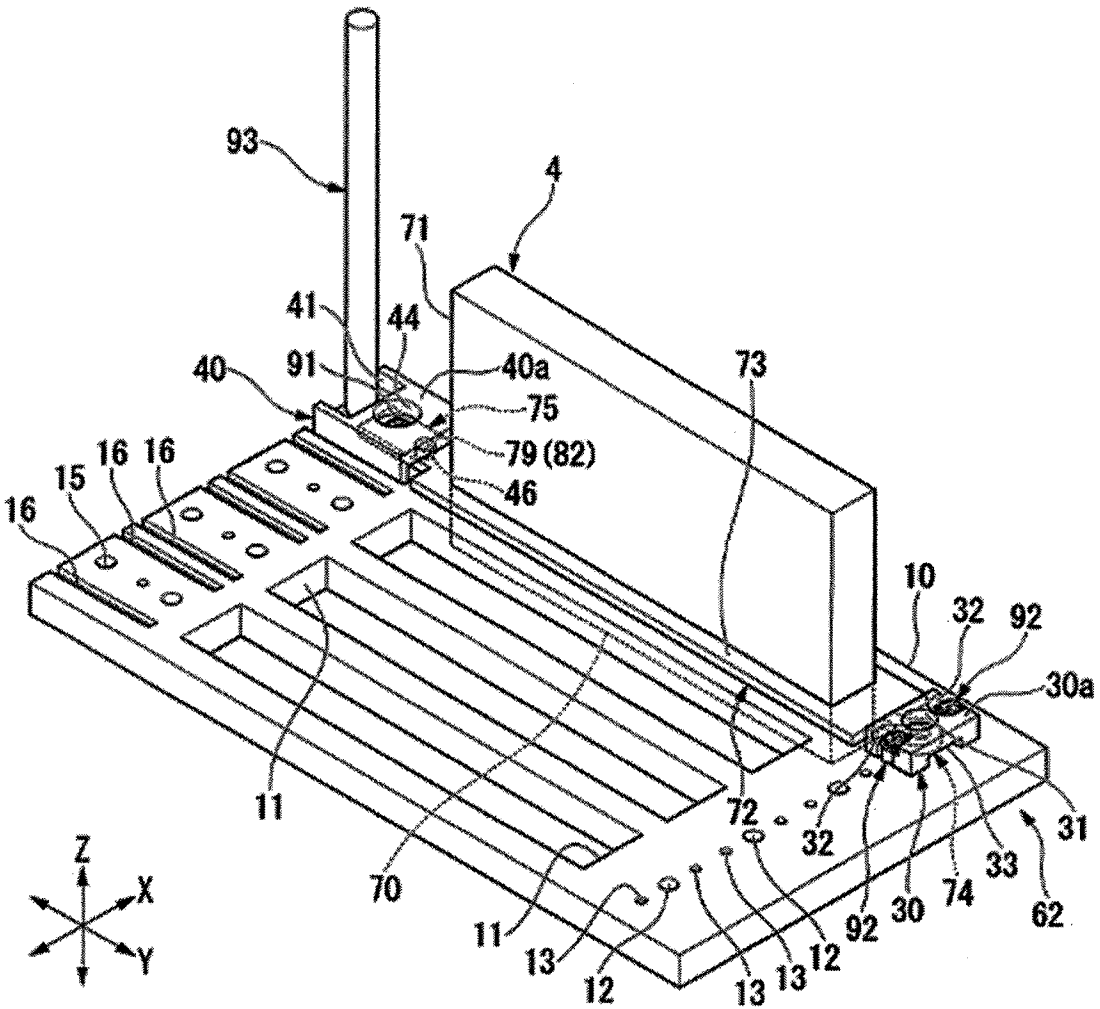
FIG. 8 is a perspective view illustrating the carriage with the liquid jet head attached through the fixing tool and a jig in the embodiment of the present invention.
Figure 9:
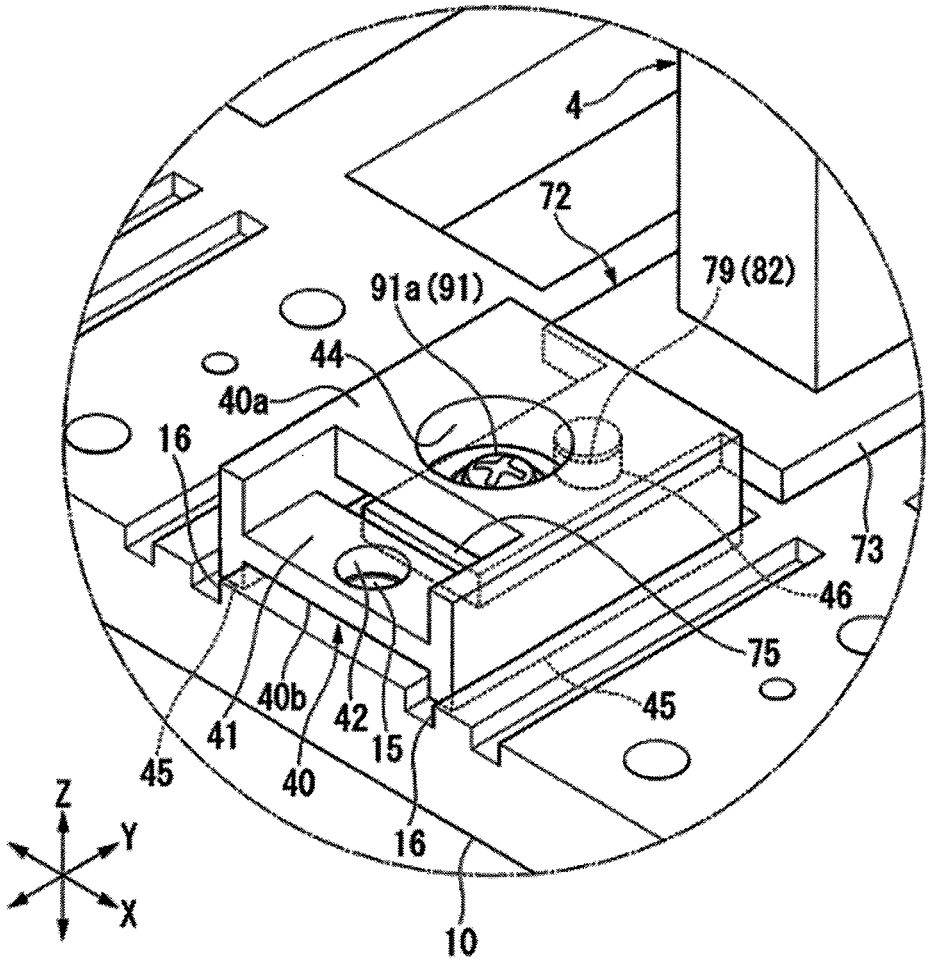
FIG. 9 is a perspective view of the jig viewed from the oblique-upper side in the embodiment of the present invention.

Under such a configuration, the support plate 72 (the liquid jet head 4) is positioned with respect to the carriage 62 using a fixing tool 30 and the jig 40 (refer to FIGS. 7, 8 and 9). Then, the support plate 72 is fixed to the carriage 62. As a result, the liquid jet head 4 is attached to the carriage 62.

(Fixing Tool)

Figure 5:
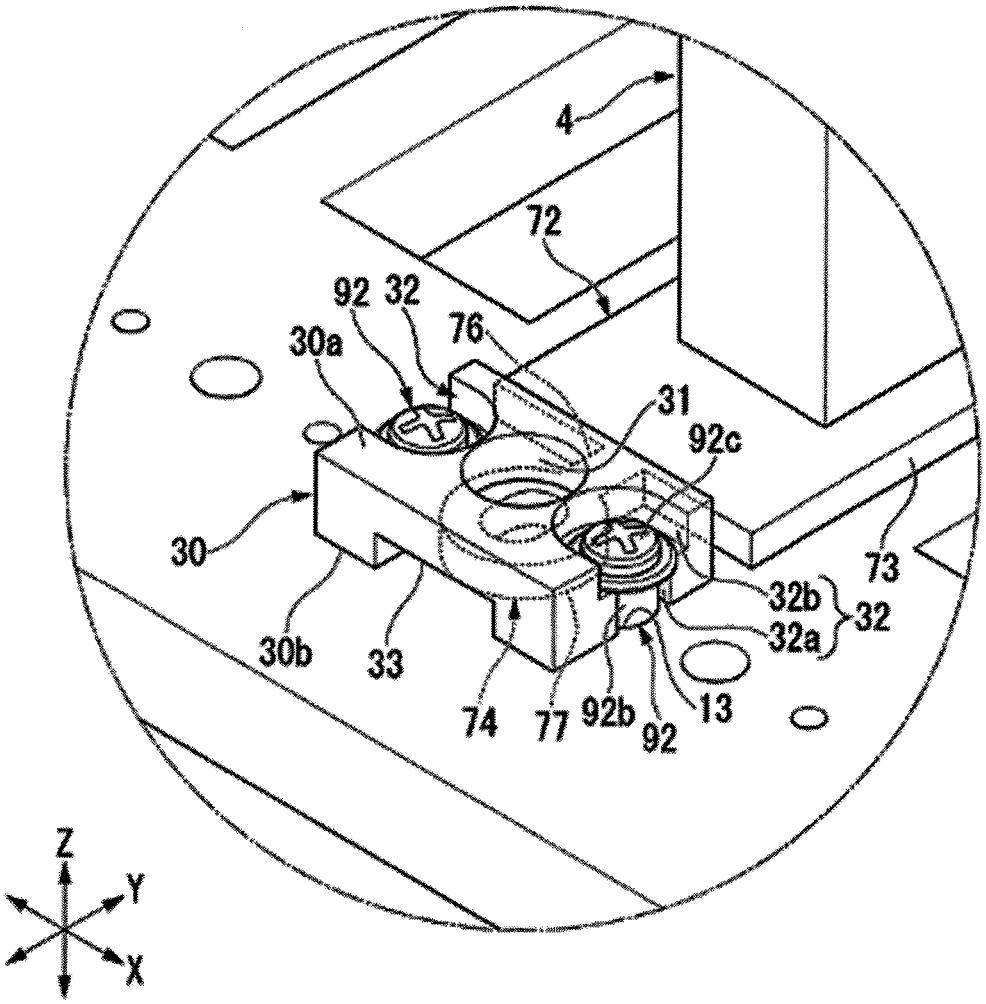
FIG. 5 is a perspective view of a fixing tool viewed from the oblique-upper side in the embodiment of the present invention.
Figure 6:
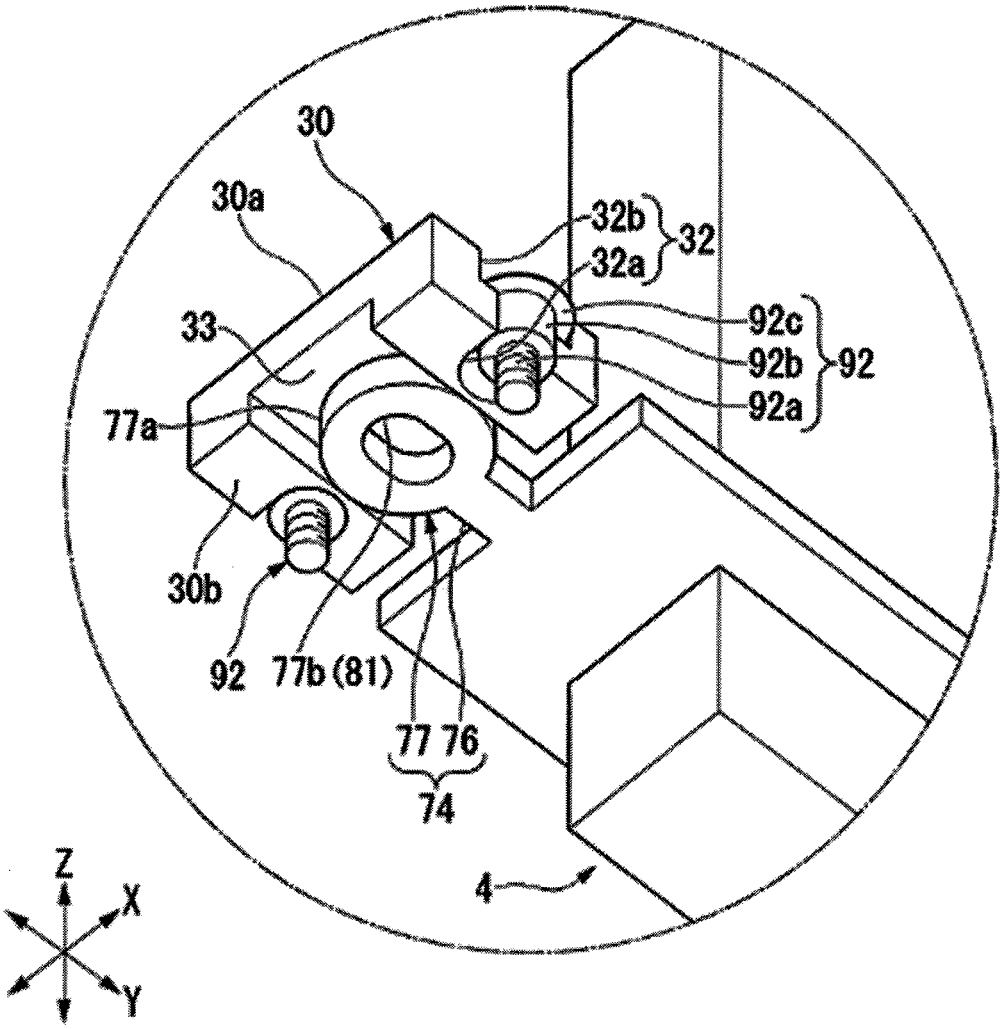
FIG. 6 is a perspective view of the fixing tool viewed from the oblique-lower side in the embodiment of the present invention.

FIG. 5 is a perspective view of the fixing tool 30 viewed from the oblique-upper side. FIG. 6 is a perspective view of the fixing tool 30 viewed from the oblique-lower side. FIG. 7 is a plan view of the fixing tool 30 viewed from the upper side in the Z direction.

As illustrated in FIGS. 2, and 5 to 7, the fixing tool 30 is attached to the first engagement portion 74 of the support plate 72. The fixing tool 30 is formed in a rectangular parallelepiped shape slightly elongated in the X direction so as to cover the base side first reference hole 12 and the female thread portions 13 of the base plate 10.

The fixing tool 30 includes a fixing tool side first reference hole 31 which is formed on substantially the X-direction center of the fixing tool 30 and communicates with the engagement portion side first reference hole 81 of the first engagement portion 74 and the base side first reference hole 12 of the base plate 10. The hole diameter of the fixing tool side first reference hole 31 is set to be larger than the diameter of the engagement portion side first reference hole 81 of the first engagement portion 74. Thus, the engagement portion side first reference hole 81 of the first engagement portion 74 and the surrounding areas of the engagement portion side first reference hole 81 are exposed through the fixing tool side first reference hole 31.

An upper face 30*a* in the Z direction of the fixing tool 30 includes first grooves 32 which are formed on both sides in the X direction, that is, at positions corresponding to the female thread portions 13 of the base plate 10. The first grooves 32 are formed by cutting both X-direction ends of the fixing tool 30 so that screws 92 which are screwed into the female thread portions 13 can be inserted into the first grooves 32. Each of the first grooves 32 is formed in a substantially semielliptical shape in plan view in the Z direction.

The first groove 32 includes a small groove 32*a* and a large groove 32*b* which communicate with each other. The small groove 32*a* is formed on the lower part in the Z direction of the fixing tool 30. The large groove 32*b* is formed on the upper part in the Z direction of the fixing tool 30 and has a larger width than the small groove 32*a*.

On the other hand, the screw 92 is a so-called stepped screw. That is, the screw 92 includes a small-diameter shaft 92*a* which is formed on the tip, a large-diameter shaft 92*b* which has a larger diameter than the small-diameter shaft 92*a* through a step, and a head 92*c* which is formed on the base end of the large-diameter shaft 92*b* at the side opposite to the small-diameter shaft 92*a*. The small-diameter shaft 92*a*, the large-diameter shaft 92*b*, and the head 92*c* are integrally molded. A male thread is formed in an engraved form on the small-diameter shaft 92*a*. On the other hand, no male thread is formed on the large-diameter shaft 92*b*.

The groove width of the small groove 32*a* is set to a groove width that enables the insertion of the large-diameter shaft 92*b* of the screw 92 into the small groove 32*a* and disables the insertion of the head 92*c* of the screw 92 into the small groove 32*a*. On the other hand, the groove width of the large groove 32*b* is set to a groove width that enables the insertion of the head 92*c* of the screw 92 into the large groove 32*b*. Specifically, the groove width of the small groove 32*a* is set to a value that enables a tiny space to be ensured between the small groove 32*a* and the large-diameter shaft 92*b*. Specifically, the groove width of the large groove 32*b* is set to a value that enables a tiny space to be ensured between the large groove 32*b* and the head 92*c* of the screw 92.

Thus, as specifically illustrated in FIG. 7, the fixing tool 30 is slidable in the X direction (refer to arrow Y1 in FIG. 7) and unslidable in the Y direction with respect to the base plate 10.

A lower face 30*b* in the Z direction of the fixing tool 30 includes a second groove 33 which is formed along the Y direction at substantially the X-direction center. The first engagement portion 74 of the support plate 72 is inserted into the second groove 33. The groove width of the second groove 33 is set to be substantially equal to the diameter of the outer peripheral face 77*a* of the head 77 of the first engagement portion 74.

In other words, the head 77 having the circular outer peripheral face 77*a* is fitted in the second groove 33 elongated in the Y direction with a sufficient space ensured between the second groove 33 and the leg 76 of the first engagement portion 74. Thus, as specifically illustrated in FIG. 7, the first engagement portion 74 (the support plate 72) is slidable in the Y direction (refer to arrow Y2 in FIG. 7) and turnable along the plane direction of the base plate 10 (refer to arrow Y3 in FIG. 7) with respect to the fixing tool 30. Further, the first engagement portion 74 is unslidable in the X direction with respect to the fixing tool 30.

(Jig)

Figure 10:
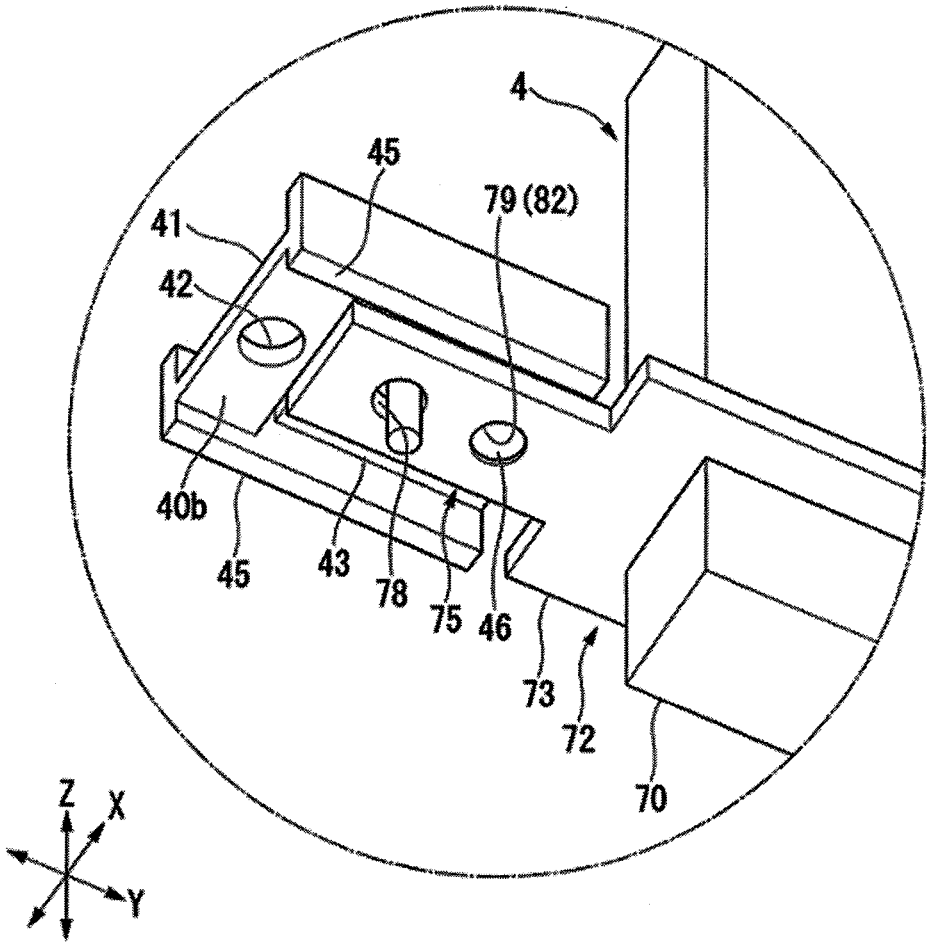
FIG. 10 is a perspective view of the jig viewed from the oblique-lower side in the embodiment of the present invention.
Figure 11:
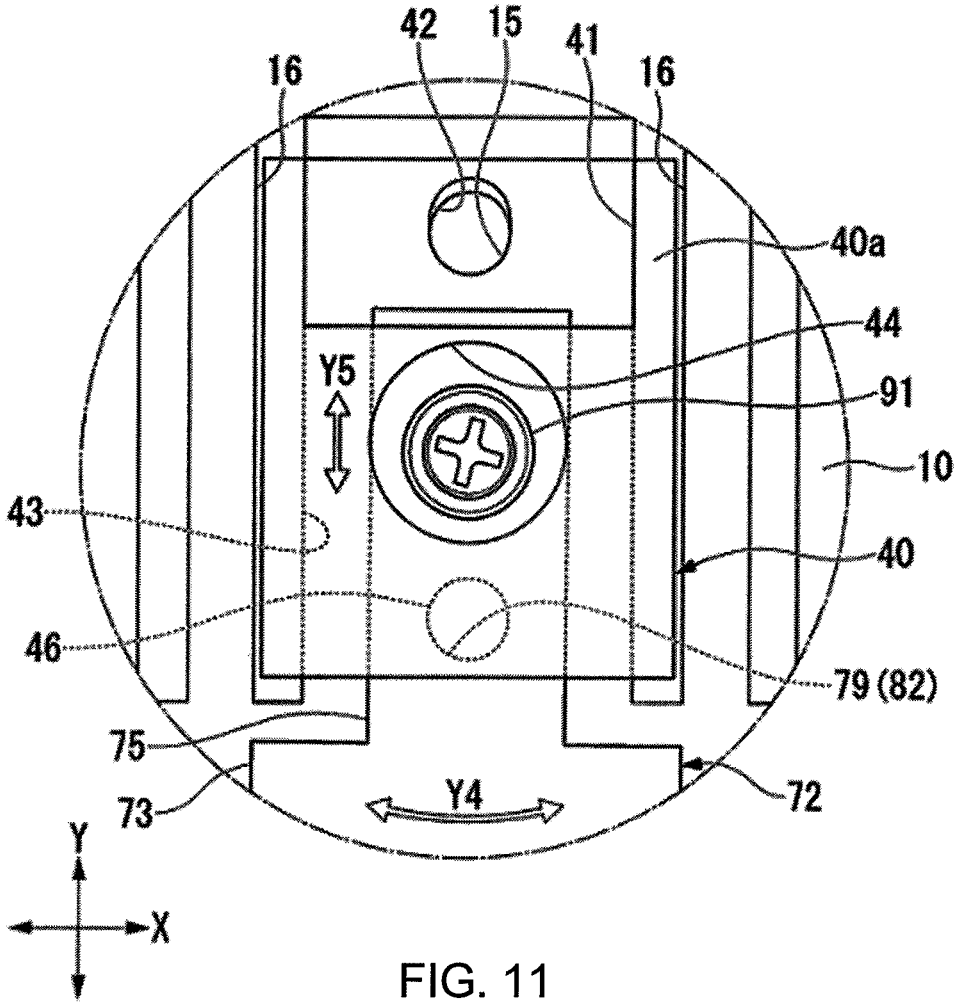
FIG. 11 is a perspective view of the jig viewed from the upper side in the Z direction in the embodiment of the present invention.

FIG. 8 is a perspective view illustrating the carriage 62 with the liquid jet head 4 attached through the fixing tool 30 and the jig 40 and corresponds to FIG. 2. FIG. 9 ,is a perspective view of the jig 40 viewed from the oblique-upper side. FIG. 10 is a perspective view of the jig 40 viewed from the oblique-lower side. FIG. 11 is a plan view of the jig 40 viewed from the upper side in the Z direction.

As illustrated in FIGS. 8 to 11, the jig 40 is attached to the second engagement portion 75 of the support plate 72. The jig 40 is formed in a rectangular parallelepiped shape slightly elongated in the Y direction so as to cover the female thread portion 17, the base side second reference hole 14, and the base side third reference hole 15 of the base plate 10.

An upper face 40*a* in the Z direction of the jig 40 includes an upper face side recess 41 which is formed at the opposite side (the other side) of the liquid jet head 4 in the Y direction. The upper face side recess 41 includes a jig side third reference hole 42 which is formed on substantially the X-direction center of the upper face side recess 41 and communicates with the base side third reference hole 15 of the base plate 10 when the jig 40 is attached to the second engagement portion 75 of the support plate 72.

The jig side third reference hole 42 is formed in an elliptical shape slightly elongated in the Y direction. That is, the width of the jig side third reference hole 42 is set to be substantially equal to the hole diameter of the base side third reference hole 15. The length of the jig side third reference hole 42 is set to be slightly larger than the hole diameter of the base side third reference hole 15.

The jig 40 includes a lower face side recess 43 which is formed on substantially the X-direction center of a lower face 40*b* along the Y direction at the side closer to the liquid jet head 4 than the upper face side recess 41 is (at the one side in the Y direction). The upper face side recess 41 and the lower face side recess 43 communicate with each other in the Y direction.

The second engagement portion 75 of the support plate 72 is inserted into the lower face side recess 43. The X-direction width of the lower face side recess 43 is set to be slightly larger than the X-direction width of the second engagement portion 75. Thus, as specifically illustrated in FIG. 11, a deviation in the attachment angle of the second engagement portion 75 (a slight movement in the Y direction and the X direction and a slight turn with respect to the plane direction of the base plate 10; refer to arrow Y4 in FIG. 11) is allowed inside the lower face side recess 43.

The jig 40 includes a through hole 44 which is formed at a position corresponding to the through hole 78 of the second engagement portion 75. The through hole 44 functions as a screw hole into which a screw 91 (described below) is inserted. The hole diameter of the through hole 44 is set to be larger than the hole diameter of the through hole 78 of the second engagement portion 75 and larger than the diameter of a head 91*a* of the screw 91. Thus, the through hole 78 of the second engagement portion 75 and the surrounding areas of the through hole 78 are exposed through the through hole 44.

The lower face side recess 43 includes a projection 46 which is formed at a position corresponding to the engagement portion side second reference hole 82 of the second engagement portion 75 and fittable with the engagement portion side second reference hole 82. The projection 46 is fitted with the engagement portion side second reference hole 82 with substantially no backlash. Accordingly, the second engagement portion 75 of the support plate 72 and the jig 40 are positioned with high accuracy and engaged with each other.

The jig 40 includes slide projections 45 which project toward the base plate 10 from both the entire X-direction sides of the jig 40. The slide projections 45 are fitted into the slide grooves 16 of the base plate 10. Thus, as specifically illustrated in FIG. 11, the jig 40 is attached slidably in the Y direction (refer to arrow Y5 in FIG. 11) and unslidably in the X direction with respect to the base plate 10.

(Position Adjustment and Fixing Method of Liquid Jet Head to Base Plate)

Next, a position adjustment and fixing method of the liquid jet head 4 with respect to the base plate 10 will be described with reference to FIGS. 12 to 16.

(Reference Fixing Method)

First, a reference (initial) fixing operation will be described.

Figure 12:
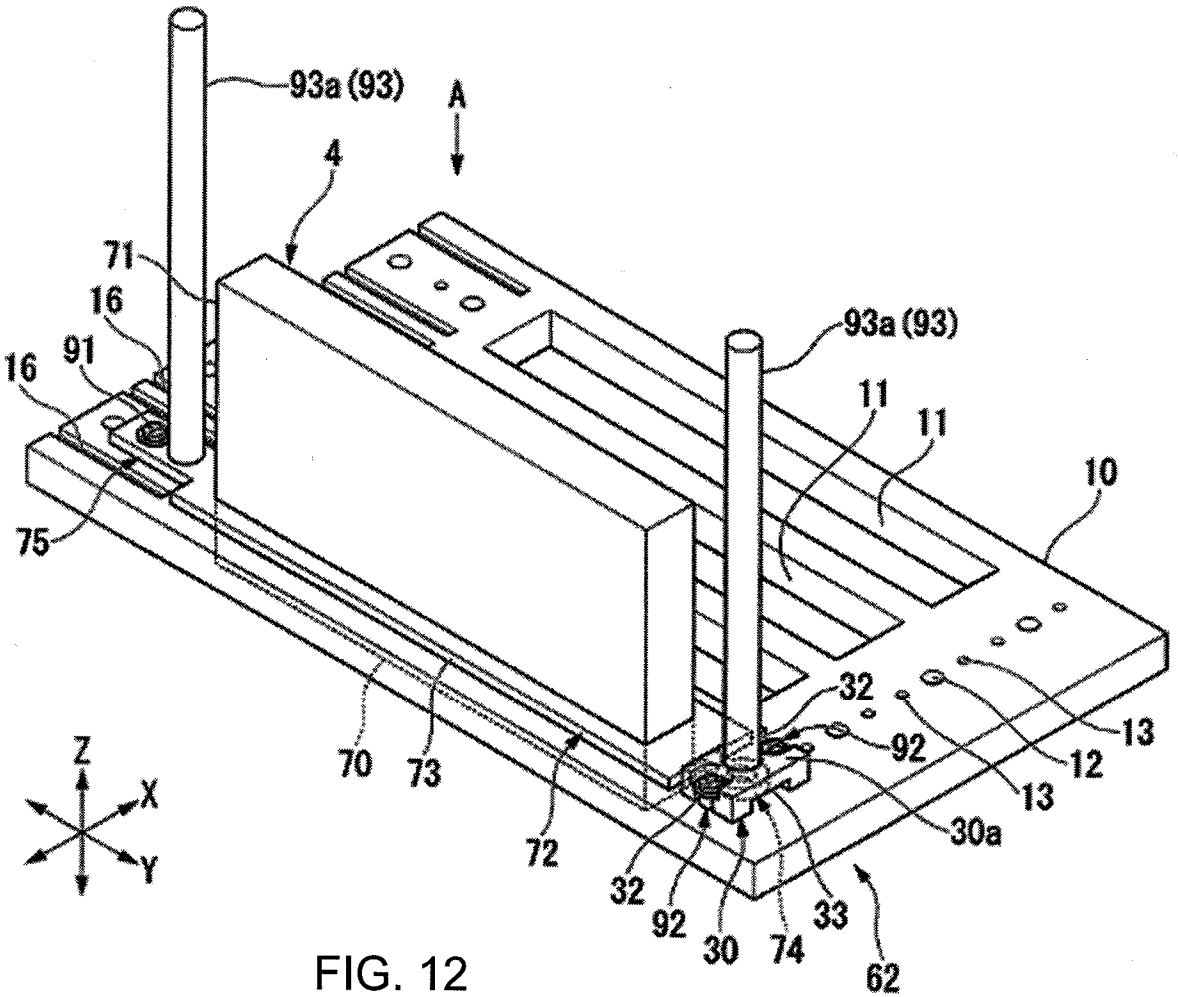
FIG. 12 is a perspective view illustrating a reference fixing method of the liquid jet head with respect to the base plate in the embodiment of the present invention.
Figure 13:
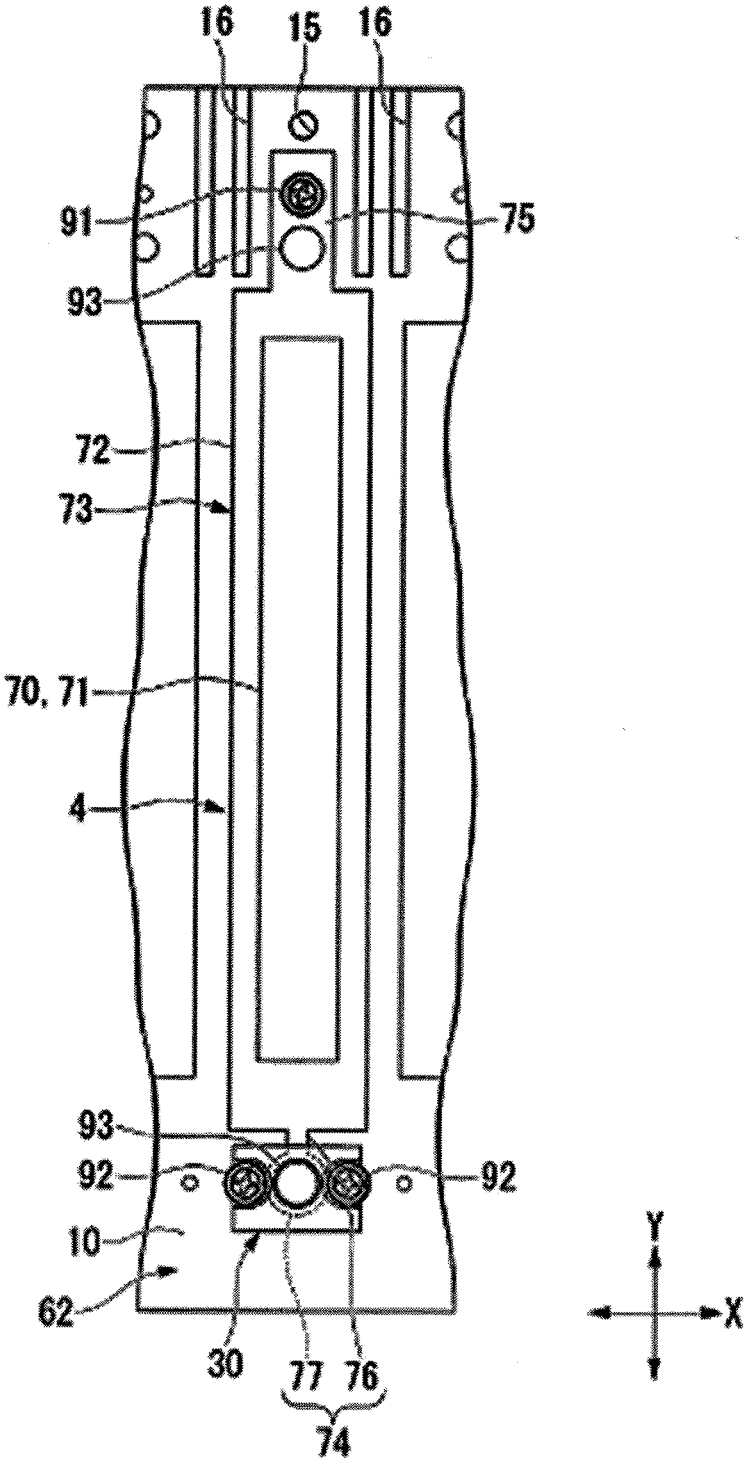
FIG. 13 is a view on arrow A of FIG. 12.

FIG. 12 is a perspective view illustrating a reference fixing method of the liquid jet head 4 with respect to the base plate 10. FIG. 13 is a view on arrow A of FIG. 12.

As illustrated in FIGS. 12 and 13, the fixing tool 30 is first set on the first engagement portion 74 (refer to FIG. 3) formed on the support plate 72 of the liquid jet head 4. At this time, the first engagement portion 74 is inserted in the second groove 33 of the fixing tool 30.

Then, the head chip 70 of the liquid jet head 4 is positioned to face the corresponding attachment opening 11 of the base plate 10 and inserted into the attachment opening 11 from the upper side in the Z direction of the base plate 10.

Then, the position of the liquid jet head 4 is roughly adjusted so that the base side first reference hole 12 (refer to FIG. 4) of the base plate 10, the engagement portion side first reference hole 81 of the first engagement portion 74, and the fixing tool side first reference hole 31 of the fixing tool 30 are located at substantially the same position when viewed from the Z direction. At the same time, the position of the liquid jet head 4 is roughly adjusted so that the base side second reference hole 14 of the base plate 10 and the engagement portion side second reference hole 82 formed on the second engagement portion 75 of the support plate 72 are located at substantially the same position when viewed from the Z direction.

Then, a reference pin 93 is inserted into the base side first reference hole 12, the engagement portion side first reference hole 81, and the fixing tool side first reference hole 31. Further, a reference pin 93 is inserted into the base side second reference hole 14 and the engagement portion side second reference hole 82.

Figure 14:
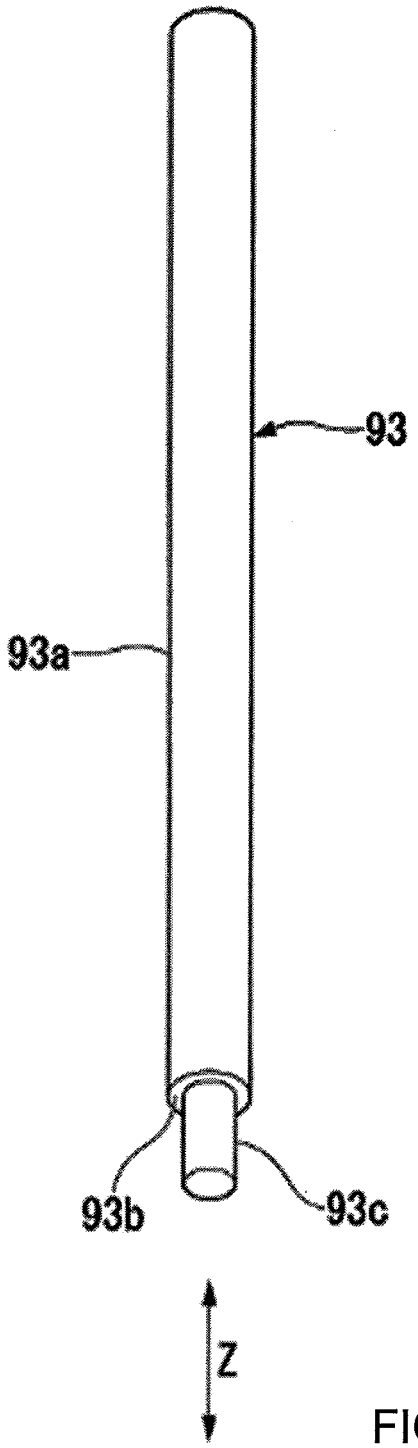
FIG. 14 is a perspective view of a reference pin in the embodiment of the present invention.

FIG. 14 is a perspective view of the reference pin 93.

As illustrated in FIG. 14, the reference pin 93 includes a pin body 93*a* and a reduced-diameter portion 93*c* which is formed on the tip of the pin body 93*a* through a step 93*b* and has a reduced diameter.

In the base side first reference hole 12, the engagement portion side first reference hole 81, and the fixing tool side first reference hole 31, the reduced-diameter portion 93*c* of the reference pin 93 is inserted into the base side first reference hole 12 and the engagement portion side first reference hole 81, and the pin body 93*a* is inserted into the fixing tool side first reference hole 31. The step 93*b* of the reference pin 93 abuts against the head 77 of the first engagement portion 74.

The reduced-diameter portion 93*c* of the reference pin 93 is inserted into the base side second reference hole 14 and the engagement portion side second reference hole 82. The step 93*b* of the reference pin 93 abuts against the second engagement portion 75.

A reference position (initial position) of the support plate 72 (the liquid jet head 4) with respect to the base plate 10 (the carriage 62) is determined by inserting the reference pins 93. In this state, as illustrated in FIGS. 10 and 12, the screws 92 are inserted from the upper side of the first grooves 32 of the fixing tool 30 and screwed into the female thread portions 13 (refer to FIG. 4) of the base plate 10.

Further, the screw 91 is inserted into the through hole 78 (refer to FIG. 3) from the upper side of the second engagement portion 75 of the support plate 72 and screwed into the female thread portion 17 (refer to FIG. 4) of the base plate 10. Accordingly, the liquid jet head 4 is fastened and fixed to the base plate 10. Then, the two reference pins 93 are removed to complete the reference fixation of the liquid jet head 4.

The positioning and fixation of the liquid jet head 4 with respect to the base plate 10 as described above is determined by the manufacture accuracy of each component of the carriage 62 and the liquid jet head 4. Thus, the fixing tool 30, the jig 40, and the reference pins 93 are used to perform fine adjustment of the liquid jet head 4 with respect to the base plate 10.

(θ Adjustment Method)

First, θ adjustment of the liquid jet head 4 with respect to the base plate 10 will be described.

Figure 15:
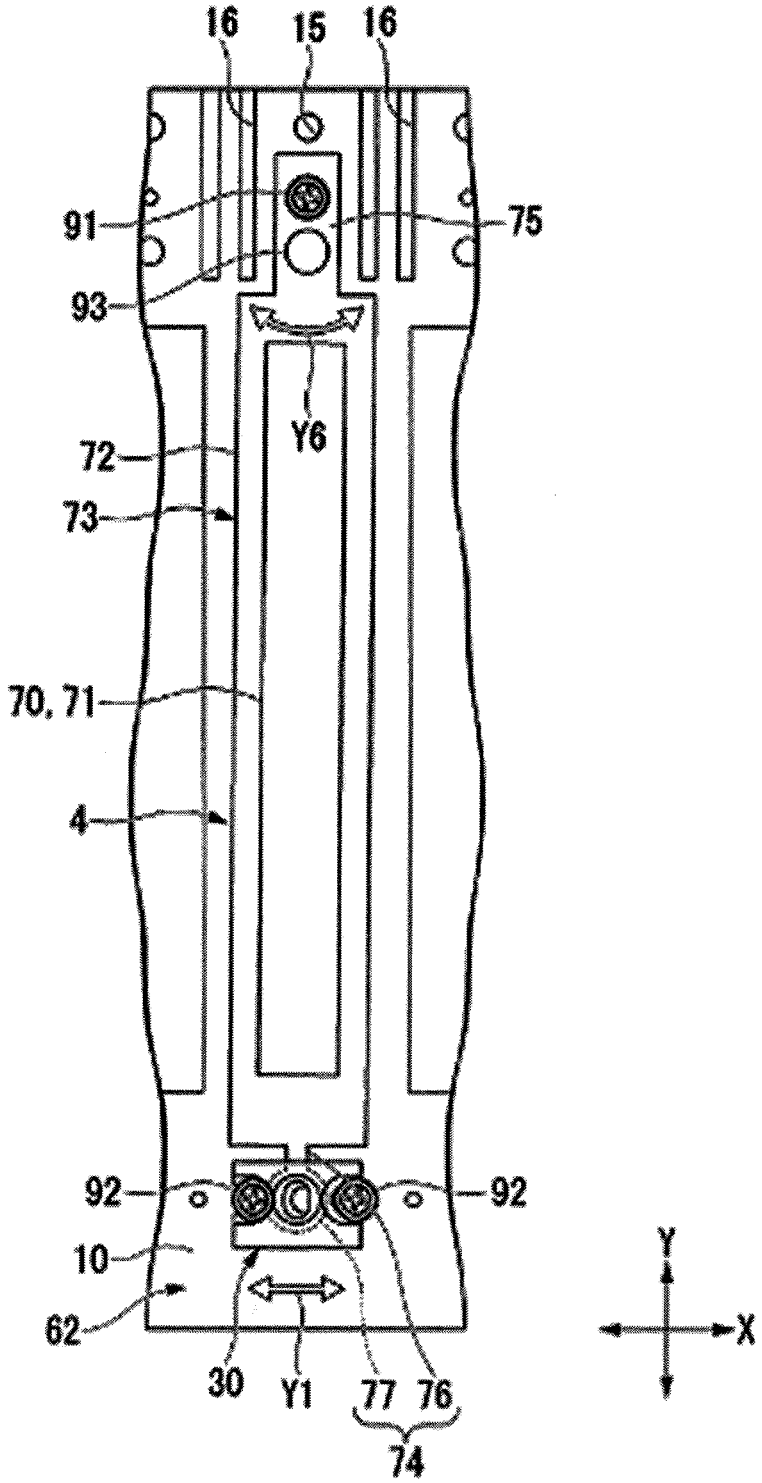
FIG. 15 is an explanatory diagram illustrating a θ -adjustment method of the liquid jet head with respect to the base plate in the embodiment of the present invention.

FIG. 15 is an explanatory diagram illustrating the θ adjustment of the liquid jet head 4 with respect to the base plate 10 and corresponds to FIG. 13.

As illustrated in FIG. 15, when the θ adjustment is performed, the reference pin 93 is first inserted into the engagement portion side second reference hole 82 of the second engagement portion 75 formed on the support plate 72 and the base side second reference hole 14 of the base plate 10. At the same time, the screws 91, 92 are slightly loosened so as to be brought into a temporarily-fixed state with no backlash.

In this state, as illustrated in FIG. 7, the fixing tool 30 can be slid only in the X direction with respect to the base plate 10 (refer to arrow Y1 in FIGS. 7 and 15). Further, the first engagement portion 74 (the support plate 72) is slidable in the Y direction (refer to arrow Y2 in FIG. 7) and turnable along the plane direction of the base plate 10 (refer to arrow Y3 in FIG. 7) with respect to the fixing tool 30. Further, the first engagement portion 74 is unslidable in the X direction with respect to the fixing tool 30.

Thus, when the fixing tool 30 is slid with respect to the base plate 10, the first engagement portion 74 turns while moving following the slide of the fixing tool 30. As a result, the support plate 72 turns around the reference pin 93 on the second engagement portion 75 (refer to arrow Y6 in FIG. 15).

Accordingly, the θ adjustment is performed. Each of the screws 91, 92 is again additionally tightened after the θ adjustment to fasten and fix the liquid jet head 4 to the base plate 10 to complete the θ adjustment.

(Y-direction Adjustment)

Next, adjustment in the Y direction (the longitudinal direction of the nozzle plate) of the liquid jet head 4 with respect to the base plate 10 will be described.

Figure 16:
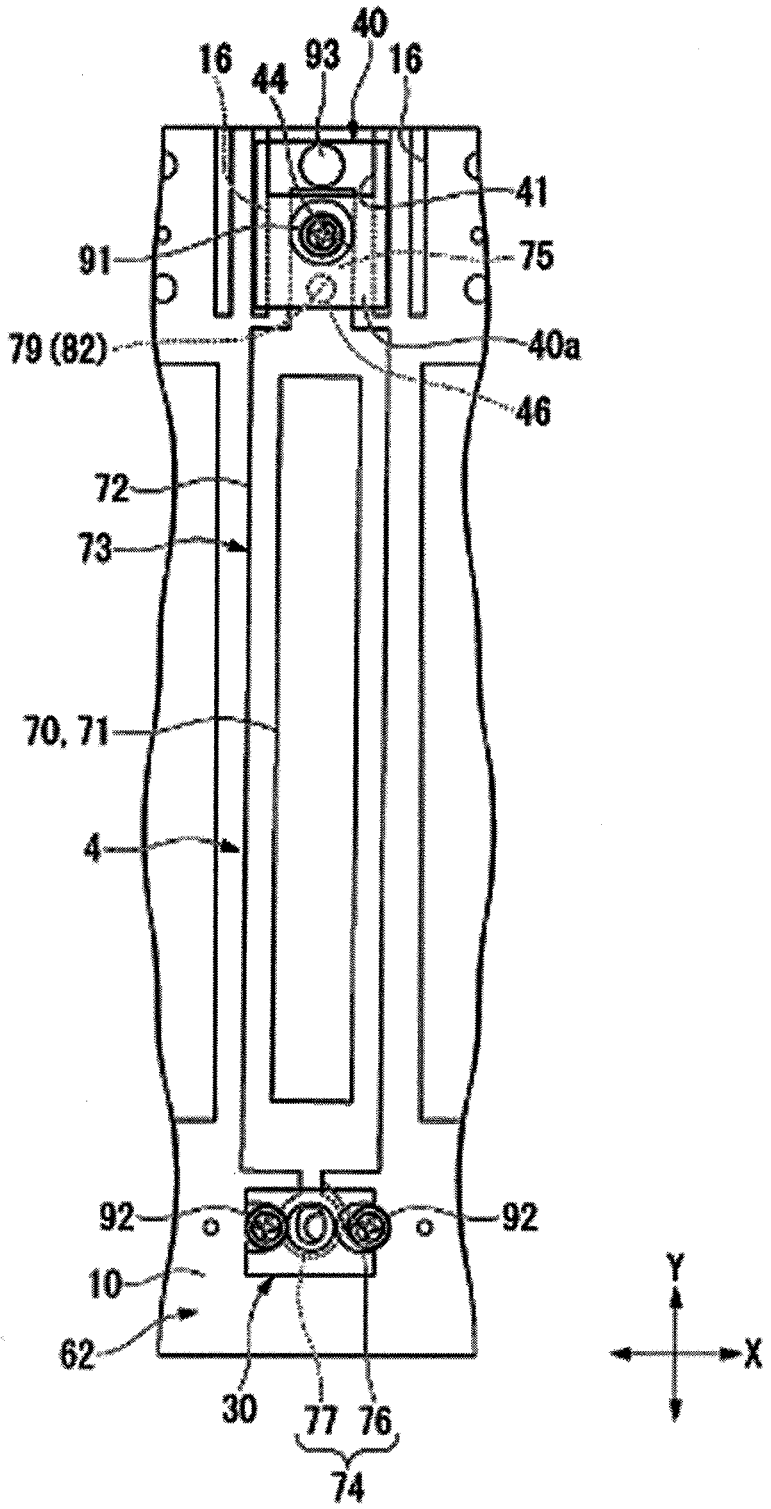
FIG. 16 is an explanatory diagram illustrating a Y-direction adjustment method of the liquid jet head with respect to the base plate in the embodiment of the present invention.

FIG. 16 is an explanatory diagram illustrating the Y-direction adjustment method of the liquid jet head 4 with respect to the base plate 10 and corresponds to FIG. 13.

As illustrated in FIG. 16, when the Y-direction adjustment is performed, the jig 40 is first set on the second engagement portion 75 of the support plate 72. At this time, the second engagement portion 75 is inserted into the lower face side recess 43 of the jig 40. The diameter of the through hole 44 (refer to FIG. 9) formed on the jig 40 is set to be larger than the diameter of the head 91*a* of the screw 91. Thus, the jig 40 can be set from the upper side of the second engagement portion 75 with the screw 91 fastened. Further, the projection 46 of the jig 40 is fittedwith the engagement portion side second reference hole 82 of the second engagement portion 75.

Simultaneously with the setting of the jig 40, the screw 91 is slightly loosened so as to be brought into a temporarily-fixed state with no backlash. Further, when the support plate 72 is unmovable in the Y direction by the additional tightening of the screws 92 in the above θ adjustment, not only the screw 91, but also the screws 92 are slightly loosened so as to be brought into a temporarily-fixed state with no backlash. In this state, as illustrated in FIGS. 8 and 16, the reference pin 93 is inserted into the base side third reference hole 15 of the base plate 10 and the jig side third reference hole 42 of the jig 40.

As specifically illustrated in FIGS. 9 and 11, the X-direction width of the jig side third reference hole 42 is set to be substantially equal to the hole diameter of the base side third reference hole 15. Further, the Y-direction length of the jig side third reference hole 42 is set to be slightly larger than the hole diameter of the base side third reference hole 15.

The slide projections 45 are formed on both the X-direction sides of the jig 40 and project toward the base plate 10 from both the entire sides. The jig 40 is attached slidably in the Y direction (refer to arrow Y5 in FIG. 11) and unslidably in the X direction with respect to the base plate 10.

In addition, in the fixing tool 30, the first engagement portion 74 is held slidably in the Y direction (refer to arrow Y2 in FIG. 7) with respect to the fixing tool 30.

Thus, the jig 40 can be slid along the Y direction with respect to the base plate 10 with the θ adjustment completed. That is, sliding the jig 40 along the Y direction enables the support plate 72 (the liquid jet head 4) which is engaged with the jig 40 to slide along the Y direction with respect to the base plate 10 with the θ adjustment completed. Accordingly, the Y-direction adjustment is performed. The screw 91 (including the screws 92 as necessary) is again additionally tightened after the Y-direction adjustment to fasten and fix the liquid jet head 4 to the base plate 10 to complete the Y-direction adjustment.

Influences on the quality of images or characters on the recording medium S caused by a deviation in the distance in the X direction between the liquid jet heads 4 can be eliminated by adjusting the timing of ejecting ink. Thus, it is not particularly necessary to perform X-direction adjustment of the liquid jet head 4 with respect to the base plate 10.

In this manner, in the above embodiment, the liquid jet head 4 is provided with the support plate 72, and the liquid jet head 4 is attached to the base plate 10 of the carriage 62 through the support plate 72. The support plate 72 is provided with the first engagement portion 74 at the one end in the Y direction. The first engagement portion 74 is pressed against the base plate 10 using the fixing tool 30 to fix the first engagement portion 74 to the base plate 10.

The fixing tool 30 is slidable in the X direction with respect to the base plate 10. The first engagement portion 74 is slidable in the Y direction with respect to the fixing tool 30.

Thus, it is possible to perform the θ adjustment of the liquid jet head 4 (the support plate 72) and also perform the adjustment in the Y direction (the longitudinal direction of the liquid jet head 4) of the liquid jet head 4 with respect to the carriage 62 (the base plate 10) with a simple structure.

The head 77 of the first engagement portion 74 has the outer peripheral face 77*a* which is formed in a circular shape centered on the straight line L1 extending along the thickness direction of the plate body 73. The first engagement portion 74 and the fixing tool 30 are engaged with each other with the outer peripheral face 77*a* fitted in the second groove 33 of the fixing tool 30. Thus, the first engagement portion 74 (the support plate 72) can be smoothly turned along the plane direction of the base plate 10 with respect the fixing tool 30.

In order to perform the θ adjustment of the support plate 72, the second engagement portion 75 is formed on the other end in the Y direction of the support plate 72. The θ adjustment of the support plate 72 is performed around the engagement portion side second reference hole 82 formed on the second engagement portion 75. That is, the θ adjustment of the support plate 72 is performed using the other end in the Y direction of the support plate 72 as a fulcrum and using the one end in the Y direction of the support plate 72 as a point of action. Thus, a sufficient distance can be ensured between the fulcrum and the point of action. Accordingly, it is possible to perform the 0 adjustment of the support plate 72 with a slight force and easily perform fine adjustment in the θ adjustment.

The fixing tool 30 includes the first groove 32 which allows the screw 92 to be inserted therein and the second groove 33 which receives the first engagement portion 74. The first groove 32 allows slide movement in the X direction of the fixing tool 30 and restricts slide movement in the Y direction of the fixing tool 30 with respect to the screw 92 (the base plate 10). The second groove 33 restricts slide movement in the X direction of the first engagement portion 74 and allows slide movement in the Y direction of the first engagement portion 74 with respect to the fixing tool 30. This configuration enables the fixing tool 30 to have a simple configuration and enables the slide direction of the fixing tool 30 and the first engagement portion 74 to be easily restricted.

In order to perform the Y-direction adjustment of the support plate 72, the jig 40 is attached to the second engagement portion 75. The second engagement portion 75 is fixed to the base plate 10 through the jig 40.

The jig side third reference hole 42 of the jig 40 is formed in an elliptical shape. The Y-direction adjustment of the support plate 72 is performed with the reference pin 93 inserted in the jig side third reference hole 42 and the base side third reference hole 15 of the base plate 10.

Thus, the jig 40 functions as a guide while maintaining the posture of the θ -adjusted support plate 72. Accordingly, it is possible to more easily perform the Y-direction adjustment of the liquid jet head 4 (the support plate 72) with respect to the carriage 62 (the base plate 10).

The slide grooves 16 each of which extends along the Y direction are formed on the base plate 10. On the other hand, the slide projections 45 which are slidably fitted in the slide grooves 16 are formed on the jig 40. Thus, the movement direction of the jig 40 with respect to the base plate 10 can be reliably restricted with a simple configuration.

The engagement portion side first reference hole 81 is formed on the first engagement portion 74 of the support plate 72, and the engagement portion side second reference hole 82 is formed on the second engagement portion 75 of the support plate 72. The fixing tool side first reference hole 31 is formed on the fixing tool 30. The reference pin 93 is inserted into each of the reference holes 81, 82, 31 to perform the reference fixation of the liquid jet head 4 with respect to the base plate 10 using the reference pin 93. Performing the θ adjustment and the Y-direction adjustment of the liquid jet head 4 after the reference fixation of the liquid jet head 4 enables these adjustment operations to be more easily performed.

The present invention is not limited to the above embodiment and includes various modifications applied to the above embodiment without departing from the gist of the invention.

For example, in the above embodiment, the fixing tool 30 includes the first groove 32 which allows the screw 92 to be inserted therein and the second groove 33 which receives the first engagement portion 74. However, the present invention is not limited thereto. It is only required that the fixing tool 30 be slidable in the X direction with respect to the base plate 10, and the support plate 72 be slidable in the Y direction and turnable in the plane direction of the base plate 10 with respect to the fixing tool 30.

In the above embodiment, the slide grooves 16 each of which extends in the Y direction are formed on the base plate 10, and the slide projections 45 which are slidably fitted in the slide grooves 16 are formed on the jig 40. However, the present invention is not limited thereto. The slide grooves 16 may be formed on the jig 40, and the slide projections 45 may be formed on the base plate 10.

In the above embodiment, the Y-direction adjustment of the liquid jet head 4 (the support plate 72) with respect to the carriage 62 (the base plate 10) is performed using the jig 40. Alternatively, for example, a guide may be used instead of the jig 40 to slide the support plate 72 (the liquid jet head 4) in the Y direction. The shape of the through hole 44 formed on the second engagement portion 75 of the support plate 72 may be changed to slide the support plate 72 in the Y direction by the through hole 44 and the head 91*a* of the screw 91.

In the above embodiment, in the positioning of the liquid jet head 4 (the support plate 72) with respect to the carriage 62 (the base plate 10), the θ adjustment is first performed, and the Y-direction adjustment is performed thereafter.

However, the present invention is not limited thereto. The θ adjustment and the Y-direction adjustment may be performed in a reversed order.

The ink jet printer has been described as an example of the liquid jet recording apparatus 1. However, the present invention is not limited thereto. For example, the liquid jet recording apparatus 1 may be a fax machine or an on-demand printing machine.

In the above embodiment, the liquid jet recording apparatus 1 for a plurality of colors provided with a plurality of liquid jet heads 4 has been described. However, the present invention is not limited thereto. For example, the liquid jet recording apparatus maybe a printer for a single color provided with one liquid jet head 4.

The shape of the carriage 62 (the base plate 10) may be changed according to the number of liquid jet heads 4. That is, the attachment openings 11 of the base plate 10 and the slide grooves 16 which are formed corresponding to the attachment openings 11 change according to the number of liquid jet heads 4.

What is claimed is:

1. A carriage comprising:

a base movable in a first direction;

a liquid jet head including a support plate attached to the base, the support plate being elongated in a second direction that intersects the first direction and extends along a plane direction of the base;

a first engagement portion formed on one end in the second direction of the support plate; and a fixing tool for positioning the support plate with respect to the base, the fixing tool being slidable in the first direction with respect to the base and engaged with the first engagement portion, wherein the support plate is supported on one face of the base turnably along the one face, and the fixing tool is configured to allow movement in the second direction of the first engagement portion with respect to the fixing tool, and restrict movement in the first direction of the first engagement portion and movement in a thickness direction of the base of the first engagement portion with respect to the fixing tool.

2. The carriage according to claim 1, wherein the first engagement portion includes a circular portion formed in a circular shape centered on a straight line extending along the thickness direction.

3. The carriage according to claim 1, wherein the other end in the second direction of the support plate is turnably supported on the base.

4. The carriage according to claim 1, further comprising:

a second engagement portion formed on the other end in the second direction of the support plate; and a jig for positioning the support plate with respect to the base, the jig being detachably attached to the base, slidable in the second direction with respect to the base, and engaged with the second engagement portion.

5. The carriage according to claim 3, further comprising:

a second engagement portion formed on the other end in the second direction of the support plate; and a jig for positioning the support plate with respect to the base, the jig being detachably attached to the base, slidable in the second direction with respect to the base, and engaged with the second engagement portion.

6. The carriage according to claim 4, wherein the first engagement portion, the fixing tool, and the second engagement portion each include reference attachment holes, each of the reference attachment holes being configured to allow a pin detachably attached, in a standing manner, to the base to be inserted therein.

7. The carriage according to claim 5, wherein the first engagement portion, the fixing tool, and the second engagement portion each include reference attachment holes, each of the reference attachment holes being configured to allow a pin detachably attached, in a standing manner, to the base to be inserted therein.

8. The carriage according to claim 4, wherein either one of the jig and a part of the base where the jig is disposed includes a slide groove extending along the second direction, and the other one includes a slide projection slidably fitted inside the slide groove, the jig includes a recess configured to receive the second engagement portion and an insertion hole configured to allow a pin detachably attached, in a standing manner, to the base to be inserted therein, and the insertion hole is formed in an elliptical shape so as to allow slide movement in the second direction of the jig.

9. The carriage according to claim 5, wherein either one of the jig and a part of the base where the jig is disposed includes a slide groove extending along the second direction, and the other one includes a slide projection slidably fitted inside the slide groove, the jig includes a recess configured to receive the second engagement portion and an insertion hole configured to allow a pin detachably attached, in a standing manner, to the base to be inserted therein, and the insertion hole is formed in an elliptical shape so as to allow slide movement in the second direction of the jig.

10. The carriage according to claim 6, wherein either one of the jig and a part of the base where the jig is disposed includes a slide groove extending along the second direction, and the other one includes a slide projection slidably fitted inside the slide groove, the jig includes a recess configured to receive the second engagement portion and an insertion hole configured to allow a pin detachably attached, in a standing manner, to the base to be inserted therein, and the insertion hole is formed in an elliptical shape so as to allow slide movement in the second direction of the jig.

11. The carriage according to claim 7, wherein either one of the jig and a part of the base where the jig is disposed includes a slide groove extending along the second direction, and the other one includes a slide projection slidably fitted inside the slide groove, the jig includes a recess configured to receive the second engagement portion and an insertion hole configured to allow a pin detachably attached, in a standing manner, to the base to be inserted therein, and the insertion hole is formed in an elliptical shape so as to allow slide movement in the second direction of the jig.

12. The carriage according to claim 1, wherein the fixing tool includes:

a first groove configured to allow a screw screwed into the base to be inserted therein; and a second groove configured to receive the first engagement portion, the first groove is elongated in the first direction so that the fixing tool is slidable in the first direction and unslidable in the second direction with respect to the screw, and the second groove is elongated in the second direction so that the first engagement portion is slidable in the second direction and unslidable in the first direction with respect to the fixing tool.

13. A liquid jet recording apparatus comprising:

the carriage according to claim 1;

a liquid jet head mounted on the carriage;

a scanning unit configured to move the carriage and the liquid jet head;

a liquid storage body configured to store liquid; and a liquid supply tube configured to circulate the liquid, the liquid supply tube being provided between the liquid jet head and the liquid storage body.

* * * * *